US005087414A

United States Patent [19]

Maniar

[11] Patent Number: 5,087,414

[45] Date of Patent: Feb. 11, 1992

[54] FREE MACHINING, MON-MAGNETIC, STAINLESS STEEL ALLOY

[75] Inventor: Gunvant N. Maniar, Bern Township, Berks County, Pa.

[73] Assignee: Carpenter Technology Corporation, Reading, Pa.

[21] Appl. No.: 500,521

[22] Filed: Mar. 28, 1990

Related U.S. Application Data

[62] Division of Ser. No. 431,480, Nov. 3, 1989, Pat. No. 4,959,513.

[51] Int. Cl.[5] ..... C22C 38/44

[52] U.S. Cl. ..... 420/43; 420/42; 420/52

[58] Field of Search ..... 420/43, 52, 42; 148/327

[56] References Cited

U.S. PATENT DOCUMENTS 3,563,729 2/1971 Kovach et al. ..... 420/43
4,329,549 5/1982 Breed ..... 420/43

FOREIGN PATENT DOCUMENTS 0260792 3/1988 European Pat. Off. .
59-229469 12/1984 Japan .

OTHER PUBLICATIONS

Handbook of Stainless Steels, Peckner and Bernstein, pp. 14-2-14-6 (1977).

*Primary Examiner*—Deborah Yee
*Attorney, Agent, or Firm*—Dann, Dorfman, Herrell and Skillman

[57] ABSTRACT

This invention provides a non-magnetic, austenitic, corrosion resistant stainless steel alloy having improved machinability, a consistently reproduceable coefficient of thermal expansion, and an essentially ferrite-free structure. The alloy contains about 0.04–0.10 w/o C, 0.03–0.07 w/o N, 2.00 w/o max. Mn, 1.00 w/o max, Si, 0.045 w/o max. P, 0.015–0.10 S, 19.00–24.00 Cr, 0.75 w/o max. Mo, 12.00–18.00 w/o Ni, and the balance iron. The alloy is balanced so that no more than about 2 v/o ferrite as determined by the DeLong diagram is present and so that the coefficient of thermal expansion is about $14.5\times10^{-6}$ to $16.5\times10^{-6}$ per C.° within the temperature range of about −51 to 121 C.

This invention further provides articles, including a non-magnetic tube in a magnetically biased accelerometer having good corrosion resistance, a coefficient of thermal expansion of about $14.5\times10^{-6}$ to $16.5\times10^{-6}$ per C.° within the temperature range of about −51 to 121 C., and containing no more than about 2 v/o ferrite as determined by the DeLong diagram and therefore, being non-magnetic.

16 Claims, 1 Drawing Sheet

FREE MACHINING, MON-MAGNETIC, STAINLESS STEEL ALLOY

This is a division of co-pending application Ser. No. 07/431,480 filed Nov. 3, 1989, now U.S. Pat. No. 4,959,513.

BACKGROUND OF THE INVENTION

This invention relates to a free machining, non-magnetic, austenitic stainless steel alloy and a magnetically biased device such as an accelerometer made therefrom. More particularly, the alloy provided has improved machinability, improved freedom from ferrite and a consistent match in its coefficient of thermal expansion (COE) with that required for coacting with a magnetic component of the magnetically biased device over a given temperature range.

The present invention stems from the discovery that difficulties hitherto encountered in the production and operation of magnetically biased accelerometers such as, for example, described in U.S. Pat. No. 4,329,549 issued on May 11, 1982 to D. S. Breed, have been caused primarily by certain less than desirable characteristics of the alloys used to fabricate the non-magnetic component of the device. In order for a magnetically biased accelerometer to function properly, this component must maintain the desired relationship with the magnetic component to close tolerances over a desired operating temperature range. However, the alloys used to fabricate the non-magnetic component exhibit excessive variations in dimensional tolerances because of less than desired machinability, small but excessive variations in the required COE and, because of the presence of greater than tolerable amounts of ferrite, more than the desired magnetic permeability. Such variations have resulted in an unacceptable rate of rejection of finished devices. These vexing problems have been encountered even though the non-magnetic austenitic stainless steel member which coacts with the magnetic member in such devices has been made of AISI Type 309S having the following composition in weight percent:

| | w/o |
|---|---|
| Carbon | 0.8 max. |
| Manganese | 2.00 max. |
| Silicon | 1.00 max. |
| Phosphorus | 0.045 max. |
| Sulfur | 0.030 max. |
| Chromium | 22-24 |
| Nickel | 12-15 |
| Iron | Bal. |

SUMMARY OF THE INVENTION

It is therefore a principal object of this invention to provide a non-magnetic, austenitic, corrosion resistant stainless steel alloy having an outstanding combination of properties including good machinability, an essentially ferrite-free structure and a COE which consistently matches a predetermined value over a required operating temperature range.

It is a more specific object of this invention to provide such a non-magnetic, austenitic stainless steel alloy which has good machinability, a coefficient of thermal expansion of about $14.5\times10^{-6}$ to $16.5\times10^{-6}$ per C.°, varying no more than ±5% within the temperature range of about −51 to 121 C., and an essentially ferrite-free structure resulting in a non-magnetic nature.

It is a further object of this invention to provide a magnetically biased device which includes a member made of such a non-magnetic, austenitic, corrosion resistant stainless steel alloy which coacts with a magnetically biased member.

The foregoing objects and advantages of the present invention are largely obtained by providing a non-magnetic, austenitic alloy as indicated in the broad range and are best obtained by providing such an alloy as indicated in the preferred range of Table I when balanced so as to have a ferrite-free structure.

TABLE I

| | w/o | |
|---|---|---|
| | Broad | Preferred |
| C | 0.04-0.10 | 0.05-0.07 |
| N | 0.03-0.07 | 0.03-0.05 |
| Mn | 2.00 max. | 1.50-2.00 |
| Si | 1.00 max. | 0.40 max. |
| P | 0.045 max. | 0.030 max. |
| S | 0.015-0.10 | 0.020-0.030 |
| Cr | 19.00-24.00 | 22.00-22.50 |
| Mo | 0.75 max. | 0.50 max. |
| Ni | 12.00-18.00 | 14.50-15.00 |

Here and throughout this application the term "ferrite-free" and synonymous expressions mean that ferrite constitutes no more than about 2 volume percent (v/o) of the alloy as calculated using the DeLong diagram as will be more fully described hereinafter. Preferably the alloy is balanced so as to contain 0 v/o ferrite in accordance with the DeLong diagram. The balance of the alloy is essentially iron, and is preferably at least about 58 w/o iron, except for the usual impurities, incidental amounts of elements used in refining and facilitating processing, and additions which do not detract from the desired properties. For example, up to about 0.75 w/o of each of the elements cobalt and copper and less than 0.01 w/o aluminum are tolerable in the alloy.

The foregoing tabulation is provided as a convenient summary and is not intended thereby to restrict the upper and lower values of the ranges of the individual elements of the alloy of this invention for use solely in combination with each other or to restrict the broad and preferred ranges of the elements for use solely in combination with each other, thus, one or more of the broad and preferred ranges can be used with one or more of the other ranges for the remaining elements. In addition, a broad or preferred minimum or maximum for an element can be used with the minimum or maximum for that element from the other range. Throughout this application, unless otherwise indicated, all compositions in percent will be in percent by weight (w/o). Further objects and advantages of the present invention will be apparent from the following detailed description and the accompanying drawing in which:

FIG. 1 is a cross-sectional view of a magnetically biased accelerometer.

DETAILED DESCRIPTION OF THE INVENTION

Figure 1:
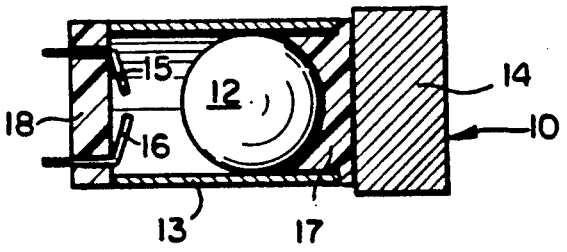

In the non-magnetic, austenitic stainless steel alloy of the present invention, carbon is a powerful austenite former when added in controlled amounts. At least about 0.04 w/o, preferably about 0.05 w/o, carbon is present in this alloy to assist in establishing the austenitic balance with essentially no free or delta ferrite.

Excessive carbon has the undesired effect of decreasing corrosion resistance because of the formation of chromium carbides. Therefore, carbon is limited to no more than about 0.10 w/o, preferably no more than about 0.07 w/o. Carbon and the remaining elements are carefully balanced to ensure the desired ferrite-free structure of the alloy.

Nitrogen is also a powerful austenite former and thus benefits the alloy by contributing to its essentially ferrite-free structure. Thus, at least about 0.03 w/o nitrogen is present in the alloy. However, too much nitrogen is deleterious to the alloy in that it adversely affects hot workability and decreases corrosion resistance because of its tendency to form chromium nitrides. Thus, nitrogen is limited to no more than about 0.07 w/o, better yet no more than about 0.06 w/o and preferably to no more than about 0.05 w/o.

Manganese when present also promotes freedom from ferrite and combines with sulfur to improve machinability; to this end up to about 2.00 w/o manganese may be present. Preferably about 1.50 w/o to 2.00 w/o manganese is present in the alloy.

Sulfur, and manganese when the latter is present, contribute to the machinability of this alloy. For that purpose, at least about 0.015 w/o, preferably at least about 0.020 w/o, sulfur is present. However, too much sulfur detracts from the hot workability of the alloy. Therefore, no more than about 0.10, preferably no more than about 0.030 w/o, sulfur is used in the alloy.

Chromium contributes to the corrosion resistance of this alloy, for that purpose, at least about 19.00 w/o, preferably at least about 22.00 w/o, chromium is present. Excessive chromium results in the presence of an objectionable amount of free ferrite. Therefore no more than about 24.00 w/o, preferably no more than about 22.50 w/o, chromium is present in the alloy.

Nickel is a strong austenite former, though not as powerful as carbon or nitrogen, and works to stabilize the alloy against formation of undesired ferrite. To this end, about 12.00 to no more than about 18.00 w/o, preferably about 14.50 to about 15.00 w/c, nickel is present.

Silicon is a strong ferrite former but can be tolerated when present in no more than about 1.00 w/o, preferably no more than about 0.40 w/o.

Phosphorus adversely affects the hot working properties of the alloy and thus no more than about 0.045 w/o, preferably no more than about 0.030 w/o, phosphorus is present in the alloy.

Molybdenum is also a ferrite former and is therefore kept below about 0.75 w/o, preferably below about 0.50 w/o.

Aluminum is limited to no more than about 0.01 w/o because of its detrimental effect on machinability.

When making this alloy the austenite-forming elements are carefully balanced against the ferrite-forming elements such that the alloy contains essentially no free ferrite, that is no more than about 2 v/o, preferably about 0 v/o ferrite as calculated by using the DeLong diagram as described in W. T. DeLong, "A Modified Phase Diagram for Stainless Steel Weld Metals" *Metal Progress* at 99-100B (February 1960). It is desirable, as is usually the case, to avoid using the minimum amount of austenite-forming elements with the maximum amount of ferrite-forming elements.

The present alloy is readily prepared by means of conventional, well-known techniques. Electric arc melting, followed by argon-oxygen decarburization (AOD) for further alloy refinement are used for good results. The alloy may be produced in various forms including billet, bar, rod, wire, plate, strip and tubing. The present alloy may be used to fabricate machinable parts requiring corrosion resistance to hot petroleum products, sulphite liquors and a variety of mineral and organic acids, and high-sulfur oxidizing flue gases (e.g., $SO_2$). Additionally, as further described hereinafter, the present alloy is especially suitable for the fabrication of the non-magnetic tube or sleeve in magnetically biased accelerometers which coacts with the magnetic mass or movable member. Such accelerometers include electromechanical crash sensors for passenger passive restraint systems. Because of its improved machinability, the present alloy is also suitable for the manufacture of articles where resistance to oxidation up to about 1030 C. is required in continuous service such as furnace parts, fire boxes and high temperature containers.

Forging is carried out from a soak temperature of about 1200-1260 C., or preferably about 1230 C., into billets. After cooling, the billet surface is inspected and prepared for hot working by removal of scale and surface defects, if any. The billet is hot worked from a temperature of about 1200-1260 C., preferably about 1230 C., cooled, and then solution annealed at a temperature of about 1045-1080 C., preferably about 1065 C., followed by water quenching.

Bar stock, a commercially important form of the present invention, is made by hot rolling the billet from about 1200-1260 C., preferably about 1230 C., cooling, solution annealing at a temperature of about 1045-1080 C., preferably about 1065 C. for about 30 min, and then water quenching. The bar stock may then be ground to finish size. An especially important use of bar stock of the present alloy is in the fabrication of the non-magnetic tube or sleeve in a magnetically biased accelerometer, which tube coacts with the magnetic mass or movable member. A bar of desired outer diameter is cut to the desired tube length and then the inner portion of the bar is machined to form a tube having precisely the desired inner diameter.

The billet may also be hot rolled from about 1200-1260 C., preferably about 1230 C., into an oversize coil, which is then cooled, solution annealed at a temperature of about 1045-1080 C., preferably about 1065 C. for about 30 minutes, and water quenched. The coil product is then straightened and cut into bars which are ground to finish size.

EXAMPLES

As examples of the present alloy, heats 1-3, each weighing approximately 33,500 lb (about 15,225 kg), were electric arc melted and further refined by argon-oxygen decarburization (AOD), then cast into 19 in (about 48 cm) diameter octagonal ingots having a nominal composition of 0.06 w/o carbon, 0.04 w/o nitrogen, 1.75 w/o manganese, 0.025 w/o sulfur, 22.25 w/o chromium and 14.75 w/o Ni. The actual composition of each heat is summarized in Table II.

TABLE II

| | w/o | | |
|---|---|---|---|
| | 1 | 2 | 3 |
| C | .059 | .060 | .062 |
| N | .054 | .046 | .047 |
| Mn | 1.62 | 1.58 | 1.55 |
| Si | .31 | .26 | .32 |
| P | .026 | .025 | .022 |
| S | .022 | .028 | .026 |

TABLE II-continued

| | w/o | | |
|---|---|---|---|
| | 1 | 2 | 3 |
| Cr | 22.40 | 22.23 | 22.13 |
| Ni | 14.94 | 14.77 | 14.54 |
| Mo | .26 | .28 | .56 |
| Cu | .29 | .22 | .23 |
| Co | .23 | .23 | .48 |

With respect to each heat the balance (bal.) was iron except for the usual small amounts of impurities. The ingots of each heat were forged from about 1230 C. into 7 in×7 in (about 18 cm×18 cm) billets. After cooling the billets were prepared for hot rolling by removal of scale and surface defects, if any. Each billet was then hot rolled from about 1230 C. into an oversize coil, solution annealed at about 1065 C. for about 30 minutes followed by water quenching. The coil product was then straightened and cut into bars which were then ground to finish size. Test specimens were cut therefrom.

Room temperature tensile tests of each heat were conducted in accordance with ASTM E8 and are summarized in Table III. More specifically, for each heat Table III shows the 0.2% yield strength (0.2% Y.S.) and ultimate tensile strength (U.T.S.), both given in thousands of pounds per square inch (ksi) and in megaPascals (MPa), as well as the percent elongation (% El.) and the percent reduction in cross-sectional area (% R.A.).

The coefficient of thermal expansion (COE) of each heat in the temperature range of about −51 to 121 C. was determined according to ASTM E228 and is given in Table III in per Celcius degree (per C.°).

Percent ferrite by volume (v/o) was calculated for each heat using the DeLong diagram and is listed in Table III.

TABLE III

| | 0.2% Y.S. | | U.T.S. | | % | % | COE | Ferrite |
|---|---|---|---|---|---|---|---|---|
| Heat | ksi | (mPa) | ksi | (mPa) | El. | R.A. | $\times 10^{-6}$/C° | v/o |
| 1 | 59 | (407) | 85.5 | (590) | 49 | 74 | 15.88 | 1.0 |
| 2 | 69 | (476) | 87 | (600) | 42 | 73 | 15.98 | 0.5 |
| 3 | 60 | (414) | 84 | (579) | 46 | 72 | 15.73 | 2.0 |

The alloy of this invention is advantageously used in providing the non-magnetic member of a magnetically biased accelerometer for actuating one or more protective devices in the event of a dangerous change in vehicular acceleration threatening one or more occupants. Referring to FIG. 1, accelerometer or velocity change sensing device 10, illustrative of an important feature of the invention, is a simplified representation of the sensor shown and described in said U.S. Pat. No. 4,329,549. To avoid unnecessary repetition, that patent is incorporated here by reference thereto. Thus, device 10 comprises a metallic tube or sleeve 13 made of the alloy of the present invention. Tube 13 can be formed by cutting the desired length from a longer seamless tube or the required length can be cut from a bar, both having the desired outer diameter. In either event, the interior surface of tube 13 is preferably machined to close tolerances to provide a passageway for a preferably spherical closely spaced movable member 12 formed of a magnetic stainless steel, such as AISI Type 431. One end of tube 13 is sealed by non-magnetic material 17 such as a suitable plastic forming a seat for magnetic member 12 against the outer surface of which a magnet 14 is fixed. The other end of tube 13 is sealed by a base 18 through which a pair of electrial leads extend and are connected to contacts 15 and 16. The contacts 15 and 16 are positioned so that the gap between them is closed by the conductive surface of magnetic member 12 when the member 12 impinges upon them.

The operation of the device 10 is such that whenever the device is subjected to a change in acceleration such that the component extending along the longitudinal axis of tube 13 away from magnet 14 is great enough, the magnetic bias on member 12 will be less than required to hold the member 12 and it will move toward the contacts 15 and 16, ultimately closing the gap between them if the force to which it is responding is great enough for a long enough time, thereby closing an electrical circuit, not shown, controlling the deployment of one or more safety devices.

Because the space between magnetic member 12 and tube 13 is constricted and serves to retard the flow of fluid from one end or the other of tube 13 around the member 12, it will be appreciated that the intended operation of the device depends upon the precision with which the interior surface of tube 13 can be machined and the closeness with which its COE adheres to the value necessary for the required coaction with the magnetic member 12 to the end that the fluid within tube 13 will provide essentially the same retarding force to the travel of member 12 away from the magnet 14 to the contacts 15 and 16 and toward the magnet 14.

By carefully controlling the composition of the alloy in accordance with the present invention there is provided improved machinability of the present alloy as compared to Type 309S as well as an improvement in the consistency with which an essentially ferrite-free structure and a predetermined coefficient of thermal expansion are maintained. All of which advantages provided by the present invention greatly reduce the number of unsatisfactory devices which must be rejected. The improvements in machinability serves to significantly improve the precision with which parts such as tube 13 can be machined and to prolong the useful life of the cutting tools.

The terms and expressions which have been employed are used as terms of description and not of limitation, and there is no intention in the use of such terms and expressions of excluding any equivalents of the features shown and described, or portions thereof, but it is recognized that various modifications are possible within the scope of the invention claimed.

What is claimed is:

1. A non-magnetic, austenitic, corrosion resistant alloy consisting essentially of, in weight percent, about

| | w/o |
|---|---|
| C | 0.04–0.10 |
| N | 0.03–0.07 |
| Mn | 2.00 max. |
| Si | 1.00 max. |
| P | 0.045 max. |
| S | 0.015–0.10 |
| Cr | 19.00–24.00 |
| Mo | 0.75 max. |
| Ni | 12.00–18.00 |

the balance essentially iron; said alloy containing no more than about 2 v/o ferrite as determined by the DeLong diagram; said alloy having a coefficient of thermal expansion of about $14.5\times10^{-6}$ to $16.5\times10^{-6}$ per C.° within the temperature range of about −51 to 121 C.

2. The alloy as recited in claim 1 wherein said alloy contains 0 v/o ferrite as determined by the DeLong diagram.

3. The alloy as recited in claim 1 having a coefficient of thermal expansion in the range of about $15.25\times10^{-6}$–$16.25\times10^{-6}$ per C.°.

4. The alloy as recited in claim 1 containing at least 0.05 w/o carbon and no more than 0.06 w/o nitrogen.

5. The alloy as recited in claim 4 containing no more than about 0.07 w/o carbon.

6. A non-magnetic, austenitic, corrosion resistant alloy consisting essentially, of, in weight percent, about

| | w/o |
|---|---|
| C | 0.05–0.07 |
| N | 0.05 max. |
| Mn | 1.50 [min.] −2.00 |
| Si | 0.40 max. |
| P | 0.030 max. |
| S | 0.020–0.030 |
| Cr | 22.00–22.50 |
| Mo | 0.50 max. |
| Ni | 14.50–15.00 |

and the balance essentially iron;

said alloy containing about 0 v/o ferrite as determined by the DeLong diagram; said alloy having a coefficient of thermal expansion of about $15.25\times10^{-6}$ to $16.25\times10^{-6}$ per C.° within the temperature range of about −51 to 121 C.

7. A non-magnetic, austenitic, corrosion resistant alloy consisting essentially of, in weight percent, about

| | w/o |
|---|---|
| C | 0.06 |
| N | 0.04 |
| S | 0.025 |
| Cr | 22.25 |
| Ni | 14.75 |

the balance essentially iron; said alloy containing no more than about 2 v/o ferrite as determined by the DeLong diagram; said alloy having a coefficient of thermal expansion of about $14.5\times10^{-6}$ to $16.5\times10^{-6}$ per C.° within the temperature range of about −51 to 121 C.

8. A fabricated article formed from the alloy of claim 1.

9. A fabricated article formed from the alloy of claim 6.

10. An alloy as recited in claim 5 containing about 0.030% max. phosphorus.

11. An alloy as recited in claim 10 containing not more than about 0.030% sulfur.

12. An alloy as recited in claim 11 containing about 0.50% max. molybdenum.

13. An alloy as recited in claim 12 containing at least about 14.50% nickel.

14. An alloy as recited in claim 13 containing at least about 1.50% manganese.

15. An alloy as recited in claim 14 containing about 0.40% max. silicon.

16. An alloy as recited in claim 15 containing at least about 22.00% chromium.

* * * * *

UNITED STATES PATENT AND TRADEMARK OFFICE

CERTIFICATE OF CORRECTION

PATENT NO. : 5,087,414

DATED : February 11, 1992

INVENTOR(S) : Gunvant N. Maniar

It is certified that error appears in the above-indentified patent and that said Letters Patent is hereby corrected as shown below:

On the title page, item [54] and in col. 1, line 1, in the title "Mon-Magnetic" should read --Non-Magnetic--.

Column 2:

Lines 54-59, the text beginning with "Further objects..." and ending with "...biased accelerometer." should be a spearate, new paragraph with the heading "Brief Description of the Drawing" inserted before new paragraph.

Column 3:

Line 41, "15.00 w/c" should read --15.00 w/o--.

Column 5:

Line 42, Table III, under the heading "% El.", first line, "49" should read --46--.

UNITED STATES PATENT AND TRADEMARK OFFICE

CERTIFICATE OF CORRECTION

PATENT NO. : 5,087,414

DATED : February 11, 1992

INVENTOR(S) : Gunvant N. Maniar

It is certified that error appears in the above-indentified patent and that said Letters Patent is hereby corrected as shown below:

Column 7:

Line23, Claim 6, in the third line under the heading "w/o", "1.50 [min]-2,00" should read --1.50-2.00--.

Signed and Sealed this

Twentieth Day of July, 1993

*Attest:*

*Attesting Officer*

Michael K. Kirk

MICHAEL K. KIRK

*Acting Commissioner of Patents and Trademarks*